US008608282B2

(12) United States Patent
Terada

(10) Patent No.: US 8,608,282 B2
(45) Date of Patent: Dec. 17, 2013

(54) LIQUID EJECTION APPARATUS

(71) Applicant: Kohei Terada, Kiyosu (JP)

(72) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/749,409

(22) Filed: Jan. 24, 2013

(65) Prior Publication Data

US 2013/0194347 A1 Aug. 1, 2013

(30) Foreign Application Priority Data

Jan. 26, 2012 (JP) ..... 2012-014131

(51) Int. Cl.
*B41J 23/00* (2006.01)

(52) U.S. Cl.
USPC ..... 347/37

(58) Field of Classification Search
USPC ..... 347/37
See application file for complete search history.

(56) References Cited

U.S. PATENT DOCUMENTS

| | | | | |
|---|---|---|---|---|
| 4,116,568 | A * | 9/1978 | Suzuki et al. | 400/320 |
| 5,105,210 | A * | 4/1992 | Hirano et al. | 346/145 |
| 5,235,353 | A * | 8/1993 | Hirano et al. | 346/145 |
| 5,418,603 | A * | 5/1995 | Kusumoto et al. | 399/16 |
| 6,305,780 | B1 * | 10/2001 | Askren et al. | 347/37 |
| 6,335,802 | B1 * | 1/2002 | Hung-Che et al. | 358/296 |
| 2004/0061739 | A1 | 4/2004 | Lewis et al. | |
| 2006/0197801 | A1 | 9/2006 | Hashii et al. | |
| 2011/0141211 | A1 | 6/2011 | Narita | |

FOREIGN PATENT DOCUMENTS

| | | | |
|---|---|---|---|
| JP | S60-038185 | A | 2/1985 |
| JP | S60-038186 | A | 2/1985 |
| JP | S60-257273 | A | 12/1985 |
| JP | H01-026485 | A | 1/1989 |
| JP | H02-008076 | A | 1/1990 |
| JP | H04-241974 | A | 8/1992 |
| JP | 2000-177193 | A | 6/2000 |
| JP | 2004-516170 | A | 6/2004 |
| JP | 2009-056687 | A | 3/2009 |
| JP | 2010-125658 | A | 6/2010 |
| JP | 4577510 | B2 | 11/2010 |
| JP | 2011-121258 | A | 6/2011 |

* cited by examiner

*Primary Examiner* — Matthew Luu
*Assistant Examiner* — Alexander D Shenderov
(74) *Attorney, Agent, or Firm* — Baker Botts L.L.P.

(57) ABSTRACT

A first common tangent of a first pulley and a second pulley is in parallel with the scanning direction. A second external common tangent of the first pulley and a third pulley intersects with the scanning direction. A motor has a shaft extended in a first direction and connected to the third pulley. An endless belt is wound on the first, second, and third pulleys. A belt connecting portion is provided on the carriage and connected to the belt in a portion on the first external common tangent. The distance between the head passing region and the third pulley is greater than a radial difference obtained as the length of the radius of the motor minus the radius of the third pulley. The distance between the head passing region and the belt connecting portion is smaller than the radial difference.

8 Claims, 12 Drawing Sheets

LIQUID EJECTION APPARATUS

CROSS REFERENCE TO RELATED APPLICATION

The present application claims priority from Japanese Patent Application No. 2012-014131, which was filed on Jan. 26, 2012, the disclosure of which is incorporated herein by reference in its entirety.

BACKGROUND OF THE INVENTION

1. Field of the Invention

The present invention relates to liquid ejection apparatuses which eject liquid.

2. Description of the Related Art

Inkjet printers are available in which a carriage mounting an inkjet head is connected to a portion extended in a scanning direction of a timing belt wound around a pair of pulleys separated from each other in the scanning direction, and in which a motor shaft is connected to one of the pulleys.

SUMMARY OF THE INVENTION

In this type of inkjet printer, the distance between the pulley and the inkjet head, and the distance between the inkjet head and the motor connected to the pulley via the motor shaft become smaller as the distance between the inkjet head and the carriage belt connecting portion connected to the belt becomes smaller in an orthogonal direction orthogonal to the scanning direction and an axial direction of the motor shaft. Further, the distance between the belt connecting portion and the inkjet head becomes greater as the distance between the inkjet head and the motor and the distance between the inkjet head and the pulley connected to the motor shaft increase in the orthogonal direction. It is therefore not possible to suppress rattling of the carriage by reducing the distance between the belt connecting portion and the inkjet head where the center of gravity of the carriage is located, and at the same time avoid the interference between the motor and the inkjet head by increasing the distance between the motor and the inkjet head and widening the moving range of the carriage.

It is accordingly an object of the present invention to provide a liquid ejection apparatus in which the belt connecting portion of the carriage can be brought close to the inkjet head while providing a wide moving range for the carriage.

The present invention provides a liquid ejection apparatus which includes: a liquid ejection head configured to eject liquid; a carriage adapted to hold the liquid ejection head and movable in a predetermined scanning direction; a first pulley and a second pulley disposed in a housing of the apparatus and separated from each other in the scanning direction, and a first common tangent of the first and second pulleys being in parallel with the scanning direction a third pulley disposed in the housing, and a second external common tangent of the first and third pulleys intersecting with the scanning direction; a motor having a rotatable shaft extended in a first direction and a larger diameter than the third pulley, the shaft being directly connected to the third pulley; an endless belt wound around the first pulley, the second pulley, and the third pulley as to circumscribe the first pulley, the second pulley, and the third pulley; and a belt connecting portion provided on the carriage and connected to the belt in a portion on the first external common tangent; the center of gravity of the carriage including the liquid ejection head being positioned as to overlap the liquid ejection head in the first direction.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
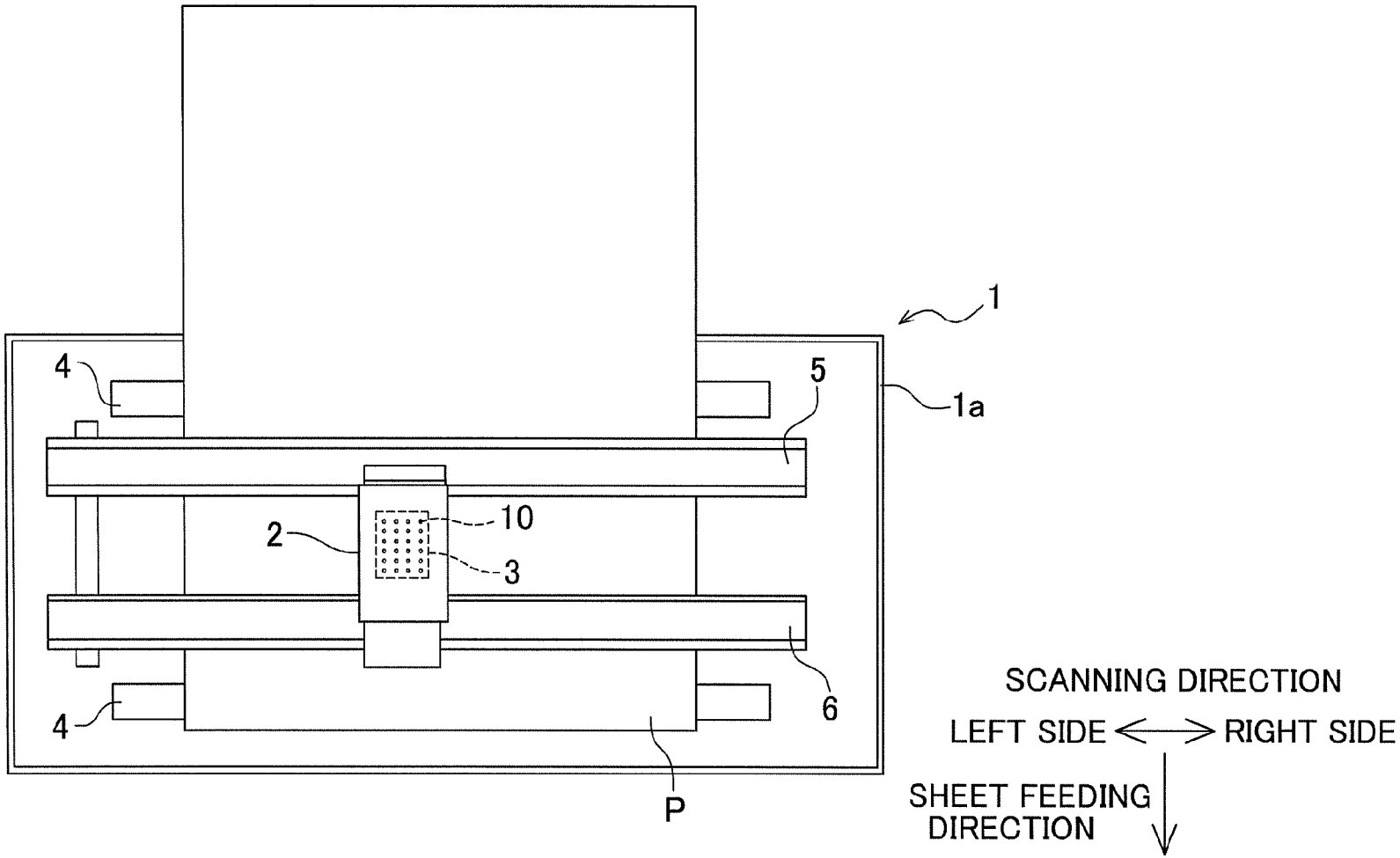
FIG. 1 is a schematic structure view of a printer according to an embodiment of the present invention.
Figure 2:
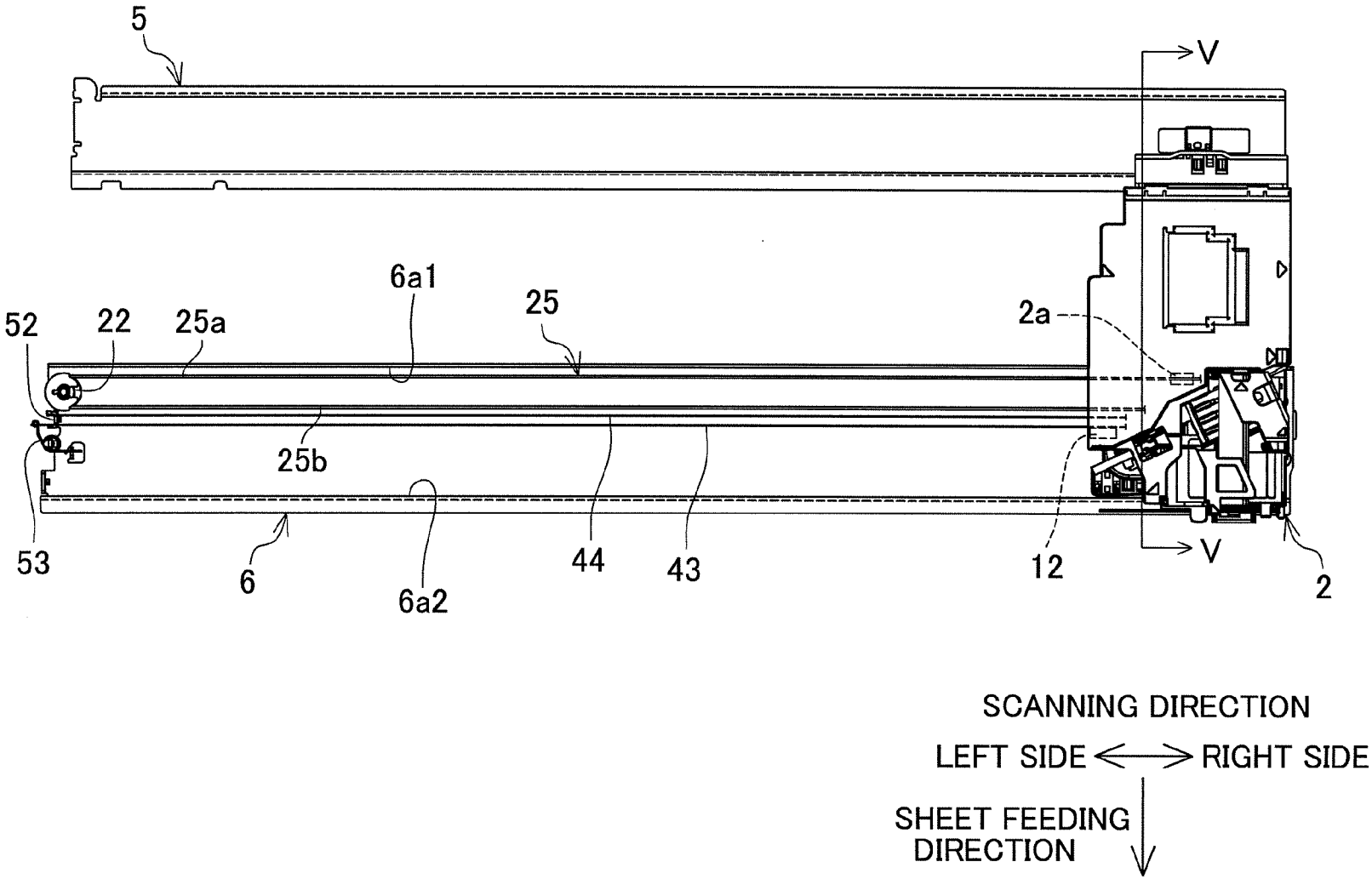
FIG. 2 is a plan view representing the structure of the carriage and the guide rails shown in FIG. 1.
Figure 3:
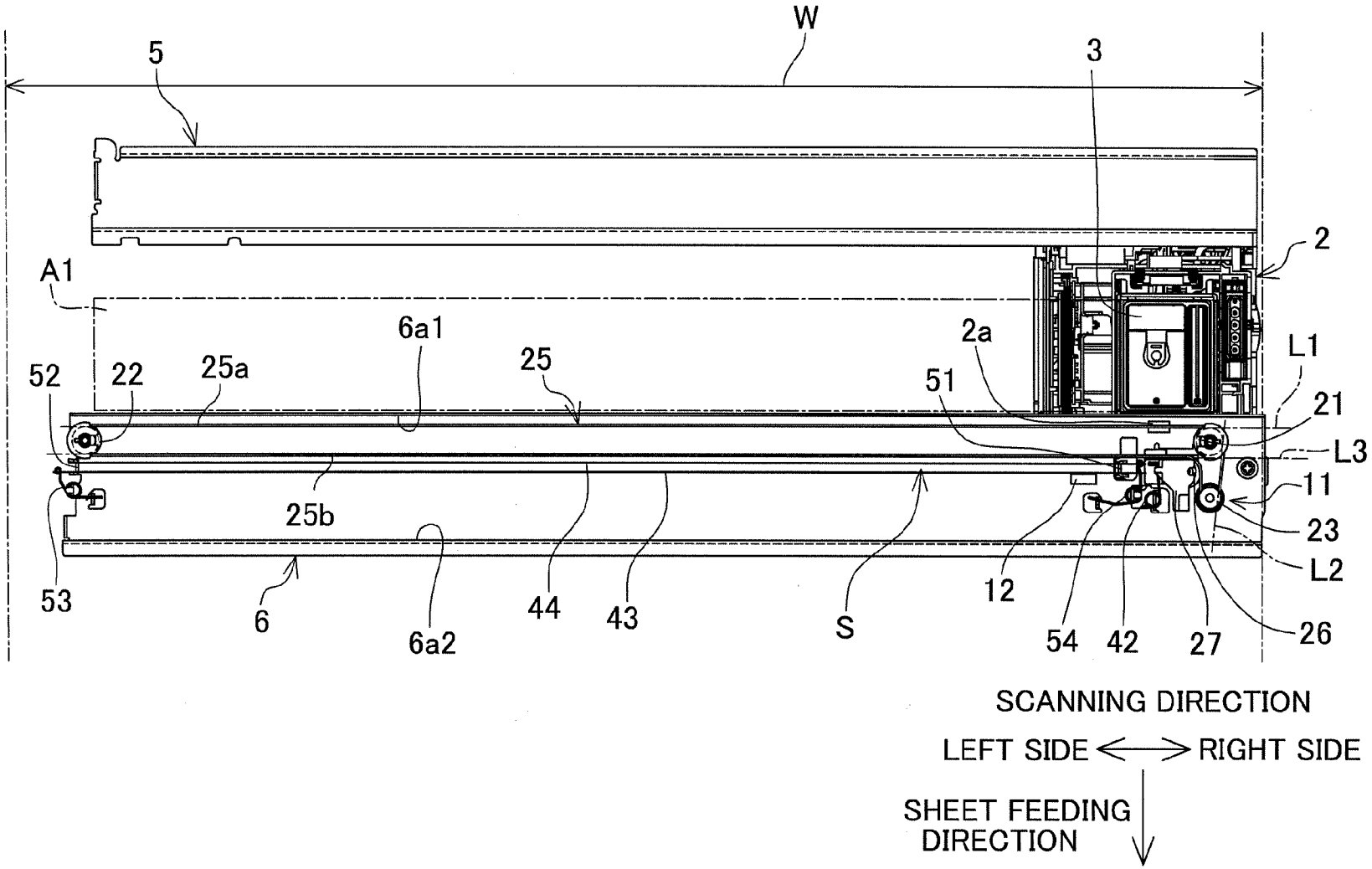
FIG. 3 is a view after removing the portion of the carriage above the guide rails from FIG. 2.
Figure 4:
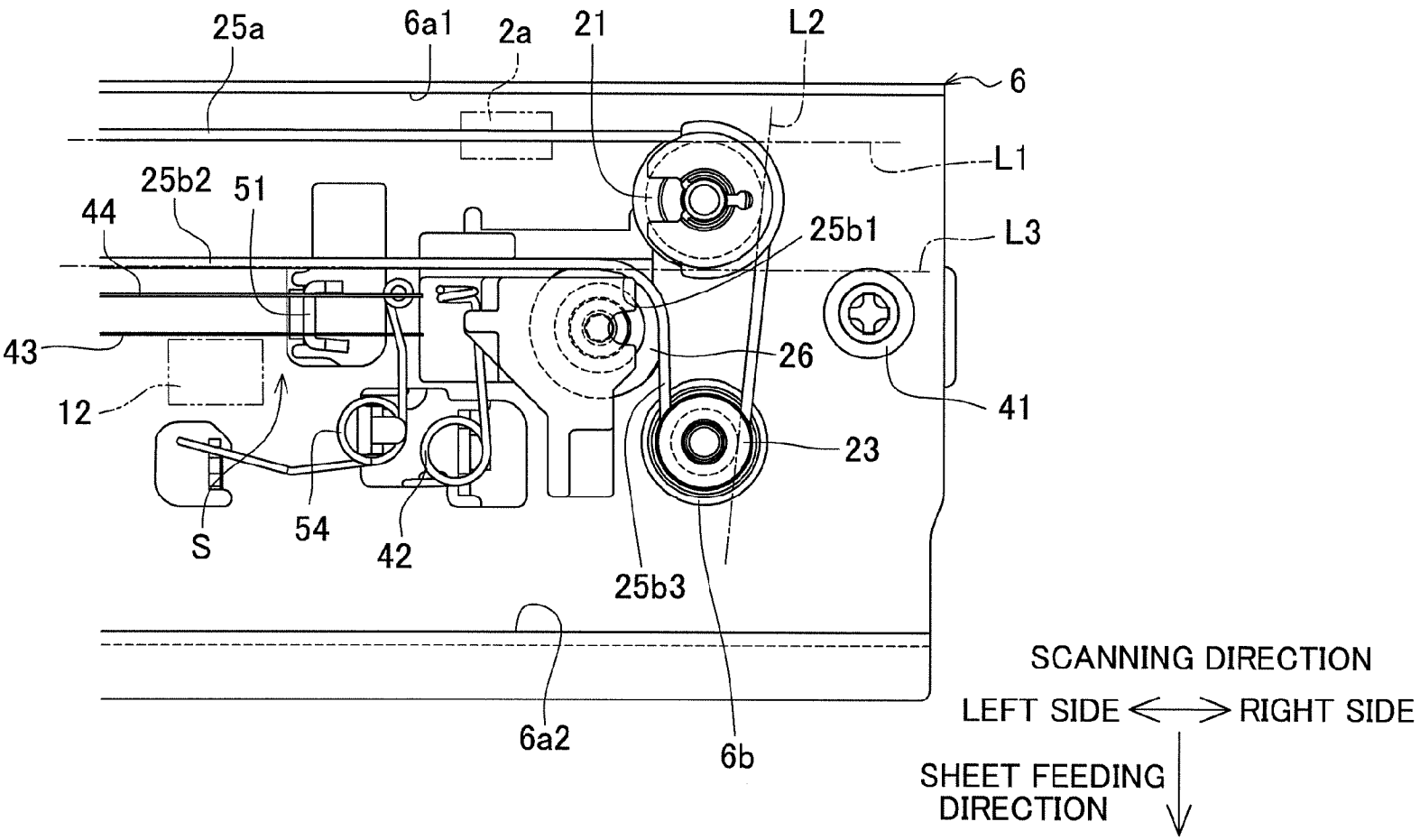
FIG. 4 is a partially magnified view of FIG. 3.
Figure 5:
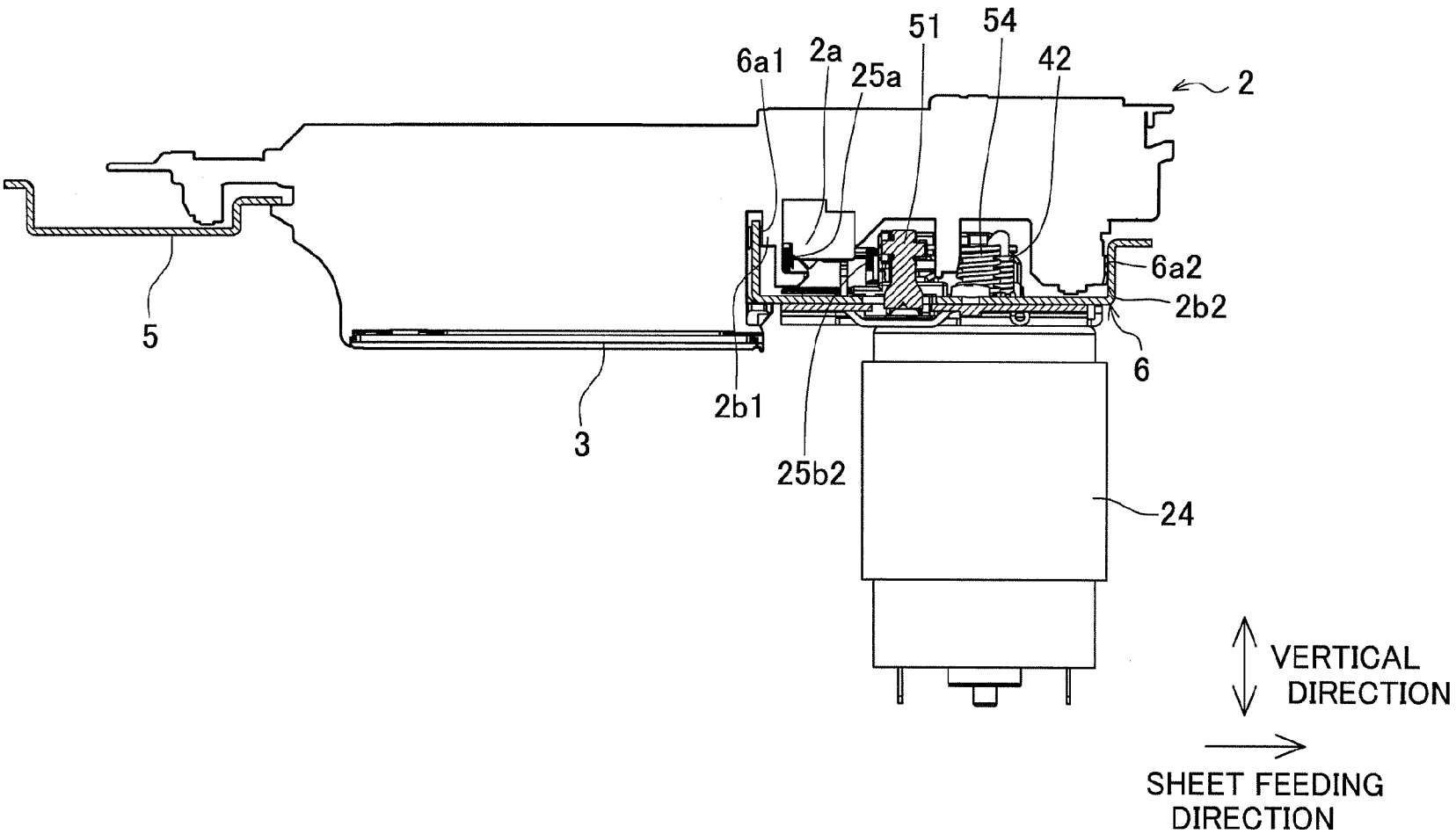
FIG. 5 is a cross sectional view taken at line V-V of FIG. 2.
Figure 6:
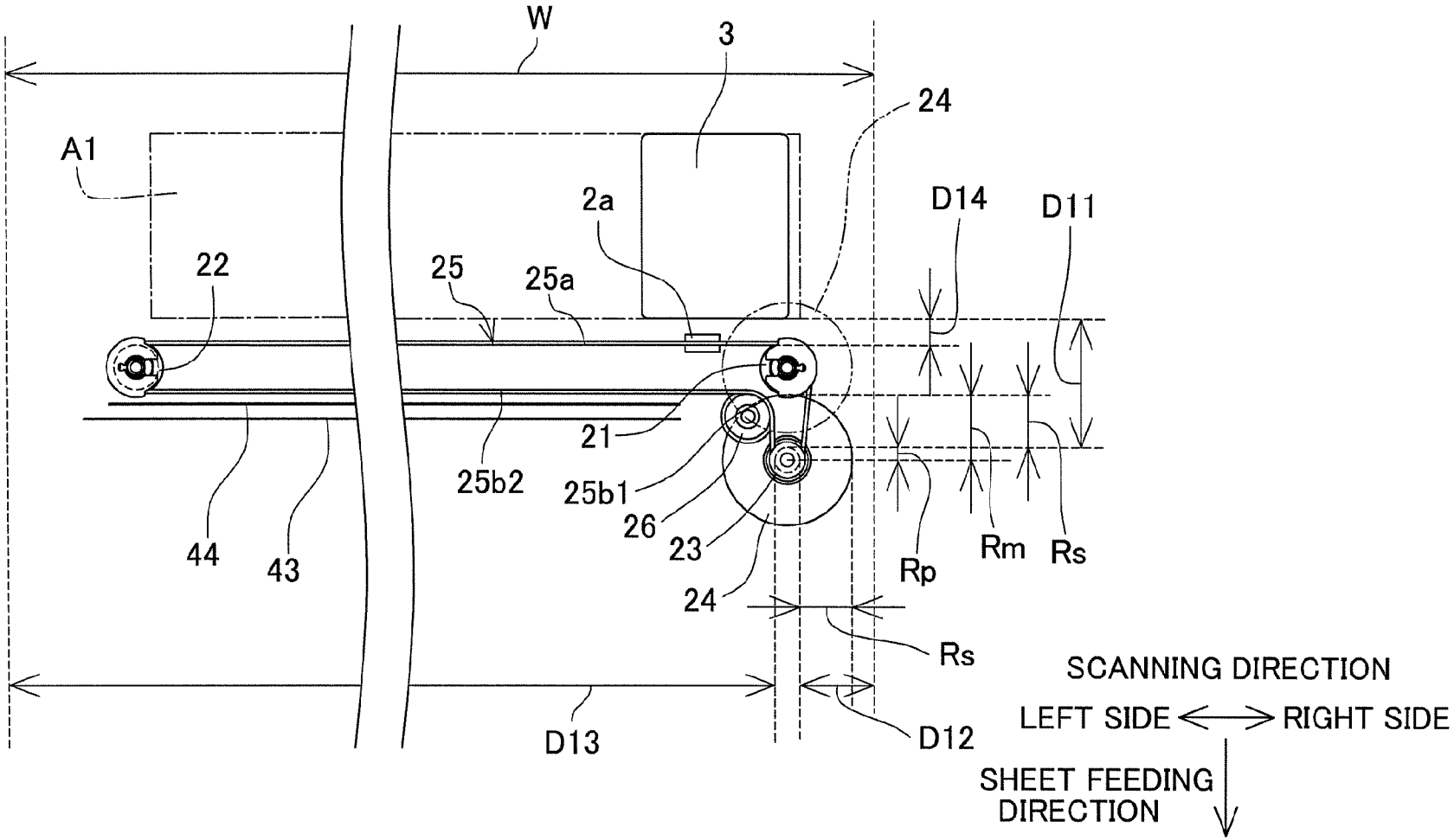
FIG. 6 is a diagram representing the relationships of the printer members with the head passing region and the moving range of the carriage.

Preferred embodiments of the present invention are described below. In the following, the right side and the left side of the scanning direction are defined as shown in FIG. 1. Further, in FIG. 1, the direction perpendicular to the plane of the paper is the vertical direction, and the directions upward and downward of the vertical direction are directions out of the plane of the paper and into the plane of the paper, respectively.

As illustrated in FIG. 1, a printer 1 as a liquid ejection apparatus according to the present embodiment includes a carriage 2, an inkjet head 3 as a liquid ejection head, and a sheet feeding rollers 4, and so on. The carriage 2 is made from materials such as a synthetic resin material, and is movable in the scanning direction along two guide rails 5 and 6 provided in a printer main body 1*a*. The carriage 2 reciprocates along the scanning direction upon driving a movement mechanism 11 which is described later. In the present embodiment, the printer main body 1*a*, including the guide rails 5 and 6, corresponds to the housing of the present invention.

The inkjet head 3 is held on the carriage 2, and ejects ink through a plurality of nozzles 10 formed on the bottom surface of the inkjet head 3. The inkjet head 3 includes a plurality of plates made of metallic material and laminated to form ink channels, and is therefore heavier than the other parts of the carriage 2. Accordingly, the center of gravity of the carriage 2 holding the inkjet head 3 overlaps substantially the central portion of the inkjet head 3 in the vertical direction representing the first direction in parallel with the axial direction of a shaft 24*a* which is described later. In the following, descriptions will be given through the case where the center of gravity of the carriage 2 is the center of gravity of the carriage 2 including the inkjet head 3. As used herein, "overlapping in the vertical direction" means overlapping when projected onto a plane orthogonal to the vertical direction. The same is the case for the scanning direction and the sheet feeding direction to be described later. The sheet feeding rollers 4 feed record sheet P in the sheet feeding direction as a second direction orthogonal to the scanning direction and the vertical direction.

In the printer 1, the record sheet P is printed as the inkjet head 3 reciprocating along the scanning direction with the carriage 2 ejects ink onto the record sheet P fed in the sheet feeding direction by the sheet feeding rollers 4. The sheet feeding rollers 4 discharge the record sheet P after the printing.

The following describes the detailed configurations of the carriage 2, the guide rails 5 and 6, and the movement mechanism 11 provided to move the carriage 2, with reference to FIGS. 2 to 6. For clarity, the internal configuration of the carriage 2 other than the inkjet head 3, a belt grip 2*a*, and sliding portions 2*b*1 and 2*b*2 is not shown in FIG. 5.

The guide rails 5 and 6 are formed from substantially rectangular plate-like members of metal or some other material extending lengthwise along the scanning direction in planar view. The plate-like members are formed into the guide rails 5 and 6 by being bent at the both end portions in the sheet feeding direction. More specifically, the guide rail 5 is bent upward at the both end portions in the sheet feeding direction, and outward of the bent portions in the sheet feeding direction. The guide rail 5 at substantially the center of the sheet feeding direction supports the bottom of the carriage 2 at the end portion on the upstream side of the sheet feeding direction.

The guide rail 6 is bent upward at the end portion on the upstream side of the sheet feeding direction. The guide rail 6 is also bent upward at the end portion on the downstream side of the sheet feeding direction, and outward of the bent portion in the sheet feeding direction. The guide rail 6 has a sliding surface 6*a*1 which extends along the scanning direction. The sliding surface 6*a*1 is the upper end portion of the vertically extending surface on the downstream side of the sheet feeding direction at the end portion of the guide rail 6 bent on the upstream side of the sheet feeding direction. The guide rail 6 also has a sliding surface 6*a*2 which extends along the scanning direction. The sliding surface 6*a*2 is the vertically extending surface on the upstream side of the sheet feeding direction at the end portion of the guide rail 6 bent on the downstream side of the sheet feeding direction.

The carriage 2 has sliding portions 2*b*1 and 2*b*2 for the sliding surfaces 6*a*1 and 6*a*2, respectively. The sliding portion 2*b*1 is in contact with the sliding surface 6*a*1 from the downstream side of the sheet feeding direction. The sliding portion 2*b*2 is in contact with the sliding surface 6*a*2 from the upstream side of the sheet feeding direction. The carriage 2 can move along the scanning direction as the sliding portions 2*b*1 and 2*b*2 slide on the sliding surfaces 6*a*1 and 6*a*2, respectively, while being restricted from rotating on the horizontal plane, specifically in directions about the axis of the shaft 24*a*, which is described later. Grease is applied to the sliding surfaces 6*a*1 and 6*a*2 for smooth sliding with the sliding portions 2*b*1 and 2*b*2.

The inkjet head 3 held on the carriage 2 is positioned between the guide rail 5 and the guide rail 6, except for the end portion on the downstream side of the sheet feeding direction. The end portion on the downstream side of the sheet feeding direction overlaps the sliding surface 6*a*1 in the vertical direction. In the present embodiment, the sliding surface 6*a*1 corresponds to the sliding surface of the present invention.

The movement mechanism 11 includes three pulleys 21 to 23, a motor 24, a belt 25, a pulley 26, and a pulley holder 27, and so on.

The pulley 21 as a first pulley is fixed to the right end portion on the top surface of the guide rail 6. The pulley 22 as a second pulley is a pulley having substantially the same diameter as the pulley 21, and is fixed to the left end portion on the top surface of the guide rail 6. Specifically, the pulley 21 and the pulley 22 are separated from each other in the scanning direction. The pulley 21 and the pulley 22 have the same position in the sheet feeding direction, and the first external common tangent L1 of the pulleys 21 and 22 on the upstream side of the sheet feeding direction is parallel to the scanning direction.

The pulley 23 as a third pulley is a toothed pulley, and is fixed to the top surface of the guide rail 6 at a position offset from the pulley 21 on the downstream side of the sheet feeding direction. The pulley 23 is thus disposed at such a position that the second external common tangent L2 of the pulley 21 and the pulley 23 intersects with the scanning direction. The pulleys 21 and 22 may be toothed pulleys as is the pulley 23, or may be toothless pulleys unlike the pulley 23. The pulley 23 may be a toothless pulley.

The motor 24 is disposed below the guide rail 6, and the shaft 24*a* rotatably provided for the motor 24 is directly connected to the pulley 23. Here, the motor 24 disposed below the guide rail 6 is connected to the pulley 23 as the shaft 24*a* is drawn above the guide rail 6 through a through hole 6*b* formed through the guide rail 6 at the portion opposite the pulley 23. The radius Rm of the motor 24 is larger than the radius Rp of the pulley 23. The upper end portion of the housing of the motor 24 is above the bottom surface of the inkjet head 3. Accordingly, the upper end portion of the motor 24 has the same height as a head passing region A1 which is described later. In other words, the upper end portion of the motor 24 has the same vertical position as the head passing region A1.

The belt 25 is an endless belt, and is wound around the pulleys 21 to 23 as to circumscribe the pulleys 21 to 23. A belt grip 2*a*, a belt connecting portion provided on the carriage 2, is connected to the belt 25 wound around the pulleys 21 to 23, at a portion 25*a* on the first external common tangent L1. In this way, the carriage 2 is fixed to the belt 25. Further, the belt grip 2*a* is disposed between the ink ejection head 3 and the pulley 23 in the sheet feeding direction.

The belt 25 is a toothed belt with a plurality of teeth formed along the inner circumference (not illustrated), and the teeth of the belt 25 are in engagement with the teeth of the pulley 23. In this way, driving the motor 24 and rotating the shaft 24*a* and the pulley 23 connected to the shaft 24*a* rotates the belt 25, which, in turn, rotates the pulleys 21 and 22. Rotating the belt 25 moves the portion 25*a* in the scanning direction. As a result, the carriage 2, connected to the portion 25*a*, moves in the scanning direction over a maximum travel range W. The inkjet head 3 passes through the head passing region A1 as the carriage 2 moves over the maximum travel range W.

The pulley 26 as a fourth pulley is disposed on the top surface of the guide rail 6, in proximity to the pulleys 21 and 23 on the left side thereof and between the pulleys 21 and 23 in the sheet feeding direction. The internal common tangent L3, which is the internal common tangent of the pulleys 22 and pulley 26 and in contact with the pulley 22 on the opposite side from the first external common tangent L1, is substantially parallel to the scanning direction. The pulley 26 is in contact with a contact portion 25*b*1 located on the outer surface of the portion 25*b* of the belt 25 between the pulleys 22 and 23, and bends the portion 25*b* of the belt 25. Bending the portion 25*b* of the belt 25 in this fashion creates a portion 25*b*2 between the contact portion 25*b*1 and the pulley 22, substantially in parallel with the scanning direction, and a portion 25*b*3 between the contact portion 25*b*1 and the pulley 23, substantially in parallel with the sheet feeding direction.

The pulley holder 27 is provided to hold the pulley 26, and is supported by the guide rail 6 so as to be movable in the scanning direction. Further, the pulley holder 27 is urged rightward by a torsion spring 42, and moves in the scanning direction to the point where the force urged by the torsion spring 42 balances the tension on the belt 25. In this way, the tension on the belt 25 is adjusted to the magnitude which corresponds to the force urged by the torsion spring 42. The pulley holder 27 is fixed to the guide rail 6 with a bolt 41 at the position where the force urged by the torsion spring 42 balances the tension on the belt 25. In this manner, the four pulleys 21 to 23, and 26 are all fixed in position in the present embodiment.

The positional relationships between the members of the printer 1 are described below in greater detail.

In the printer 1, the pulley 23 is disposed at a position offset from the pulley 21 on the downstream side of the sheet feeding direction, as described above. More specifically, the distance D11 between the head passing region A1 and the pulley 23 in the second direction, which is in parallel with the sheet feeding direction, is greater than the radial difference Rs, which is the length of the radius Rm of the motor 24 minus the radius Rp of the pulley 23 (Rs=Rm−Rp).

The pulley 23 is described below in more detail with regard to its position in the scanning direction. The pulley 23 is disposed within the both ends of the maximum travel range W of the carriage 2 in the scanning direction, and at a position at which the distance D12 between the pulley 23 and the right end of the maximum travel range W in the scanning direction is equal to or greater than the radial difference Rs. Because the pulley 23 is disposed at the right end portion of the guide rail 6, the distance D13 between the pulley and the left end of the maximum travel range W in the scanning direction is evidently greater than the distance D12. Accordingly, the distance D13 is greater than the radial difference Rs, as with the case of the distance D12.

The distance D14 between the belt grip 2*a* and the head passing region in the second direction, which is in parallel with the sheet feeding direction, is smaller than the radial difference Rs.

The vertical positional relationships are described below. The pulleys 21 to 23 are positioned below the sliding surface 6*a*1 and the sliding portion 2*b*1 of the carriage 2. Accordingly, the belt 25 wound around the pulleys 21 to 23 is also positioned below the sliding surface 6*a*1 and the sliding portion 2*b*1, specifically a position offset from the sliding surface 6*a*1 in the vertical direction.

The pulley 26 bends the portion 25*b* of the belt 25 between the pulley 22 and the pulley 23. This creates a space S which extends in the scanning direction over the top surface of the guide rail 6, downstream of the portion 25*b*2 of the belt 25 in the sheet feeding direction and upstream of the axis of the pulley 23 in the sheet feeding direction. Specifically, the space S extends in the scanning direction over the top surface of the guide rail 6 at a position between the portion 25*b*2 and the plane which passes through the axis of the pulley 23 and is in parallel with the scanning direction.

An encoder film 43 and a protective film 44 are disposed in the space S. The encoder film 43 is a film extending along the scanning direction. The right and left end portions of the encoder film 43 are attached to film attaching portion 51 and 52, respectively, provided on the top surface of the guide rail 6. The left end portion of the encoder film 43 attached to the film attaching portion 51 and 52 is pulled leftward by a torsion spring 53 provided on the top surface of the guide rail 6. The encoder film 43 thus extends in the scanning direction without a slack.

The encoder film 43 has a plurality of slits (not illustrated) formed along the scanning direction. The carriage 2, on the other hand, is provided with a position detecting element 12 in a portion opposite from the surface of the encoder film 43 on the downstream side of the sheet feeding direction. The position detecting element 12 is provided to detect the slits of the encoder film 43 and detect the position of the carriage 2. In the present embodiment, the encoder film 43 and the position detecting element 12 together correspond to the encoder of the present invention.

The protective film 44 is a film extending along the scanning direction, and is disposed between the encoder film 43 and the portion 25*b*2 of the belt 25. The both end portions of the protective film 44 in the scanning direction are attached to portions of the film attaching portion 51 and 52, respectively, on the upstream side of the encoder film 43 in the sheet feeding direction. The right end portion of the protective film 44 attached to the film mounts 51 and 52 is pulled rightward by a torsion spring 54 provided on the top surface of the guide rail 6. The protective film 44 thus extends in the scanning direction without a slack. The protective film 44 prevents the portion 25*b*2 of the belt 25 from contacting the encoder film 43.

Here, assume that, unlike the present embodiment, the pulleys 23 and 26 are not provided, and the belt 25 is wound around the pulleys 21 and 22 with the shaft 24*a* of the motor 24 being directly connected to the pulley 21, as described above. In this case, the motor 24, which overlaps the head passing region A1 in the sheet feeding direction as described above, also overlaps the head passing region A1 in the scanning direction, as indicated by dashed-two dotted lines in FIG. 6, when the belt grip 2*a* is where the distance D14 becomes smaller than the radial difference Rs. Specifically, the distance D11 becomes equal to or less than the radial difference Rs.

As such, the inkjet head 3 and motor 24 interfere if the carriage 2 is moved over the maximum travel range W and the inkjet head 3 passes over the head passing region A1 as in the present embodiment. Avoiding such interference between the inkjet head 3 and the motor 24 requires the right end of the moving range of the carriage 2 to be more toward the left and narrowing the maximum travel range W than in the present embodiment, so that the motor 24 and the head passing region do not overlap each other in the sheet feeding direction.

On the other hand, the belt grip 2*a* would be disposed more downstream of the sheet feeding direction than in the present embodiment and the distance D14 would become equal to or greater than the radial difference Rs if the motor 24 were disposed where it does not overlap the head passing region A1 in the scanning and the sheet feeding direction, specifically a position where the distance D11 becomes equal to or greater than the radial difference Rs, in order to move the carriage 2 over the maximum travel range W. As a result, the belt grip 2*a* will be far distant apart from the center of gravity of the carriage 2 when the motor 24 has a large radius Rm, and the carriage 2 may rattle heavily when the belt 25 is rotated to accelerate and move the carriage 2 in the scanning direction.

For these reasons, the configuration in which the shaft 24*a* of the motor 24 is directly connected to either of the pulleys 21 and 22 fails to increase the maximum travel range W by making the distance D11 greater than the radial difference Rs, and at the same time to bring the belt grip 2*a* closer to the center of gravity of the carriage 2 by making the distance D14 smaller than the radial difference Rs.

On the other hand, in the printer 1 of the present embodiment, the motor 24 is mounted on the pulley 23 different from the pulleys 21 and 22. It is therefore possible to adjust the positional relationships between the pulleys 21 and 22 and the pulley 23 in a manner allowing the pulley 23 to be offset from the pulleys 21 and 22 on the downstream side of the sheet feeding direction by a distance which corresponds to the radius Rm of the motor 24 and the radius of the pulley 23. In this way, the distance D14 can be made smaller than the radial difference Rs while making the distance D11 greater than the radial difference Rs.

Because the distance D11 is greater than the radial difference Rs, the motor 24 does not overlap the head passing region A1 in the scanning direction. Accordingly, there will be no interference between the inkjet head 3 and the motor 24, regardless of how far the inkjet head 3 moves in the scanning direction. The maximum travel range W of the carriage 2 can thus be increased as a result.

The distance D14 is smaller than the radial difference Rs. Accordingly, the belt grip 2*a* is disposed at a position close to the inkjet head 3, specifically the center of gravity of the carriage 2, regardless of the radius Rm of the motor 24. This makes it possible to suppress the rattling of the carriage 2 upon rotating the belt 25 and accelerating and moving the carriage 2 in the scanning direction.

In the present embodiment, the belt grip 2*a* can thus be brought close to the center of gravity of the carriage 2 while increasing the maximum travel range W.

Further, in the present embodiment, the pulley 23 is positioned within the both ends of the maximum travel range W of the carriage 2 in the scanning direction, and the distances D12 and D13 are equal to or greater than the radial difference Rs. The motor 24 thus does not protrude from the maximum travel range W in the scanning direction. It is therefore not required to increase the size of the printer 1 in the scanning direction to dispose the motor 24, making it possible to miniaturize the printer 1.

Further, in the printer 1, the portion 25*a* of the belt 25 where the belt grip 2*a* is connected is disposed downstream, in the sheet feeding direction, of the sliding surface 6*a*1 provided at the end of the guide rail 6 on the upstream side of the sheet feeding direction, specifically at a position distant apart from the center of gravity of the carriage 2. However, in the present embodiment, the sliding surface 6*a*1 vertically overlaps the end portion of the inkjet head 3 on the downstream side of the sheet feeding direction, as described above. This enables the portion 25*a* of the belt 25 disposed opposite from the inkjet head 3 over the sliding surface 6*a*1, and the belt grip 2*a* connected to the portion 25*a* to be disposed closer to the center of gravity of the carriage 2 than when the sliding surface 6*a*1 is disposed downstream of the inkjet head 3 in the sheet feeding direction.

Further in the present embodiment, the belt 25 is disposed below the sliding surface 6*a*1, even though the portion 25*a* of the belt 25 is in proximity to the sliding surface 6*a*1 on the downstream side of the sheet feeding direction. In this way, the grease applied to the sliding surface 6*a*1 does not touch the belt 25 even when the portion 25*a* of the belt 25 momentarily bends toward the sliding surface 6*a*1.

Further, in the present embodiment, the tension pulley 26 bends the belt 25 at the portion 25*b* between the pulley 22 and the pulley 23. This creates the space S which extends in the scanning direction downstream of the portion 25*b*2 of the belt 25 in the sheet feeding direction and upstream of the pulley 23 in the sheet feeding direction. The encoder film 43 and the protective film 44, extending in the scanning direction, are disposed in the space S. The printer 1 can thus be reduced in size by making effective use of the space S in this fashion.

Further, because the portion 25*b* of the belt 25 is bent by the pulley 26, the portion 25*b*2 is disposed more upstream of where it would have been when the portion 25*b* was not bent by the pulley 26, specifically closer to the portion 25*a* where the belt grip 2*a* is connected. Accordingly, the encoder film 43 disposed in the space S in proximity to the portion 25*b*2 of the belt 25 on the downstream side in the sheet feeding direction is also disposed close to the portion 25*a* of the belt 25, and is not easily affected by the accidental posture change of the carriage 2 during the travel. The position of the carriage 2 can thus be accurately detected by detecting the slits of the encoder film 43 with the position detecting element 12.

Further, in the present embodiment, the encoder film 43 is disposed downstream of the portion 25*a* of the belt 25 in the sheet feeding direction where the belt grip 2*a* is connected, specifically opposite from the inkjet head 3 over the portion 25*a*. Thus, the encoder film 43 can be disposed without increasing the distance between the belt grip 2*a* and the inkjet head 3 in the sheet feeding direction.

Further, in the present embodiment, the pulley 26 bends the portion 25*b* of the belt 25, as described above. Accordingly, the wind angle of the belt 25 for the pulley 23 is larger than when the portion 25*b* is not bent by the pulley 26. This ensures that the power from the pulley 23 is reliably transmitted to the belt 25 without causing defects such as jumping.

Further, in the present embodiment, the central axis positions of the pulleys 21 to 23 and the pulley 26 are all fixed to the guide rail 6. The tension of the belt 25 can thus be fixed at the assembly tension. Further, with the pulleys 21 to 23 and 26 fixed, jumping of the belt 25 can be prevented without providing an excessively large tension for the belt 25. It is therefore possible to reduce the tension on the belt 25 and thus the frictional resistance between the pulleys 21 to 23 and their rotational axes, or between the rotational axes of the pulleys 21 to 23 and the bearings. The load on the motor 24 can thus be reduced.

Modifications of the present embodiment are described below. In the following, descriptions concerning the configurations already described in the embodiment above are omitted as appropriate.

In the foregoing embodiment, the pulley 23 connected to the shaft 24*a* of the motor 24 is disposed within the both ends of the maximum travel range W of the carriage 2 in the scanning direction, and the distances D12 and D13 are equal to or greater than the radial difference Rs. As a result, the motor 24 does not protrude out of the maximum travel range W in the scanning direction. However, the present invention is not limited to this.

Figure 7:
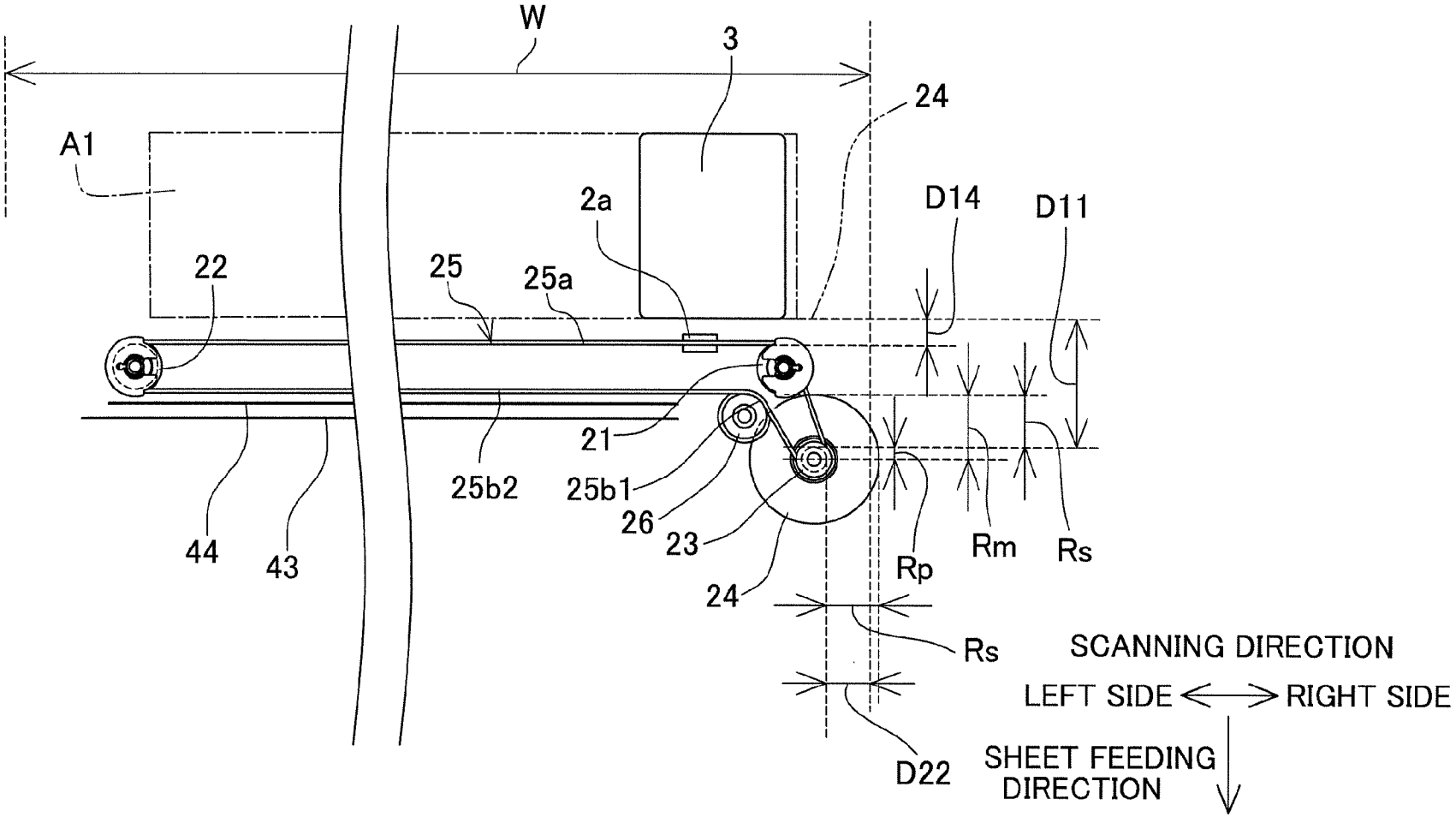
FIG. 7 is a diagram equivalent of FIG. 6, representing modification 1.

For example, as illustrated in FIG. 7, the pulley 23 may be positioned within the both ends of the maximum travel range W of the carriage 2 in the scanning direction, and the distance D22 between the pulley 23 and the right end of the maximum travel range W in the scanning direction may be greater than the radial difference Rs to partially protrude the motor 24 rightward of the maximum travel range W (modification 1).

Further, the pulley 23 is not necessarily required to be disposed within the both ends of the maximum travel range W of the carriage 2 in the scanning direction. Specifically, the pulley 23 may protrude out of the maximum travel range W in the scanning direction either partially or entirely, provided that the motor 24 overlaps the head passing region A1 in the sheet feeding direction.

The foregoing embodiment described the case where the encoder film 43 and the protective film 44 are disposed in the space S created downstream of the portion 25*b*2 of the belt 25 in the sheet feeding direction. However, the present invention is not limited to this. Specifically, other components of the printer 1 may be disposed in the space S, or nothing may be disposed in the space S.

Figure 8:
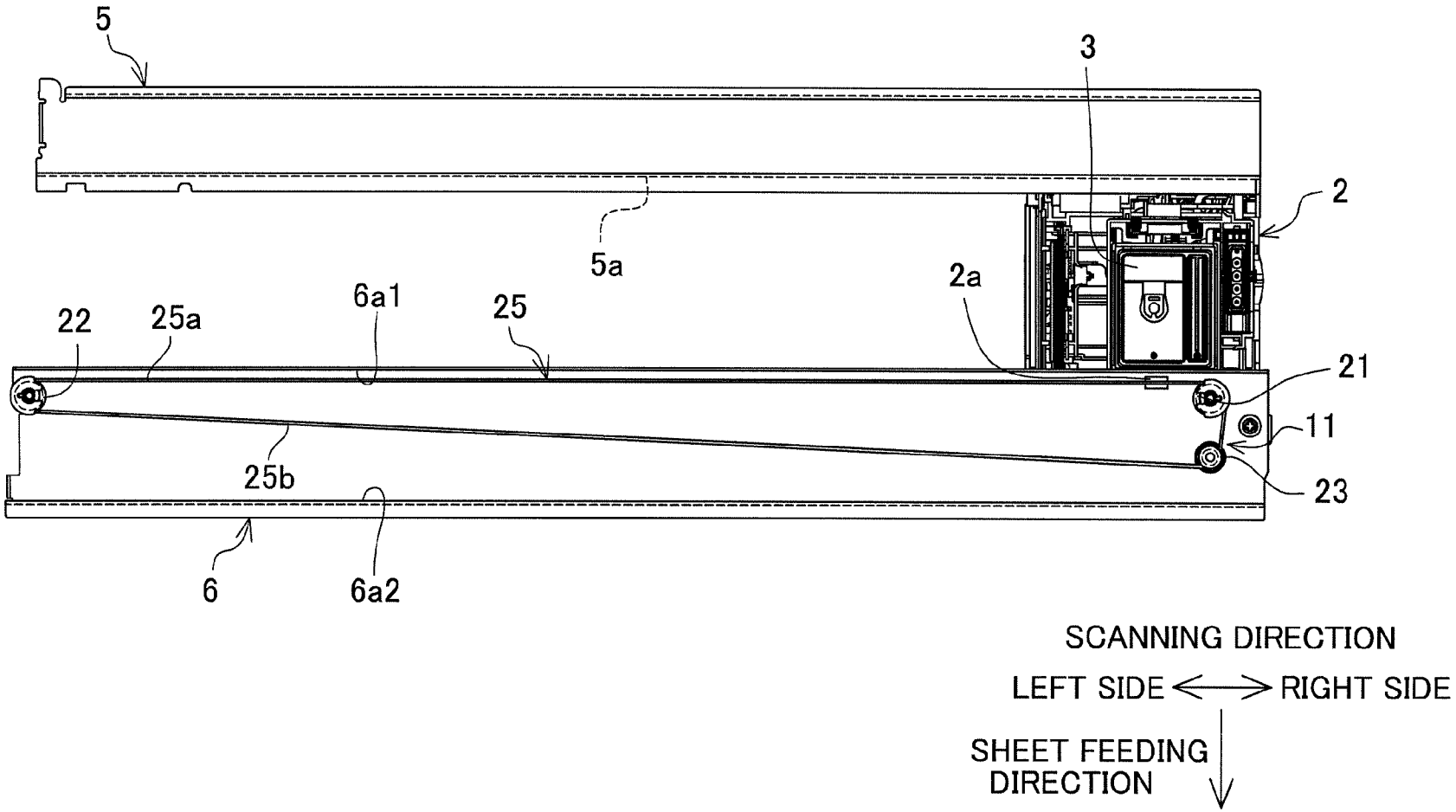
FIG. 8 is a diagram equivalent of FIG. 6, representing modification 2.

The foregoing embodiment described the case where the pulley 26 bends the portion 25*b* of the belt 25 to create the space S downstream of the horizontally extending portion 25*b*2 of the belt 25 in the sheet feeding direction. However, the present invention is not limited to this. For example, as illustrated in FIG. 8, the pulley 26 may not be provided, and the belt 25 may be wound around the pulleys 21 to 23 (modification 2).

The foregoing embodiment described the case where the pulleys 21 to 23, and the pulley 26 are all fixed to the guide rail 6 to fix the tension of the belt 25 at the assembly tension. However, the present invention is not limited to this.

For example, the pulley holder 27 urged by the torsion spring 42 may not be fixed to the guide rail 6, and the pulley 26 may be movable in the scanning direction. In this case, the pulley holder 27 moves in the scanning direction as to balance the tension on the belt 25 and the force urged by the torsion spring 42.

The foregoing embodiment described the case where the pulley 26 movable in the scanning direction with the pulley holder 27 is provided to adjust the tension on the belt 25. However, the present invention is not limited to this. Either the pulley 21 or the pulley 22 may be movable in the scanning direction to adjust the tension on the belt 25. Alternatively, the pulley 23 may be movable in the sheet feeding direction to adjust the tension on the belt 25.

The foregoing embodiment described the case where the belt 25 is disposed below the sliding surface 6*a*1. However, the present invention is not limited to this. For example, the belt 25 may be disposed above the sliding surface 6*a*1. It is also possible in this case to prevent the grease applied to the sliding surface 6*a*1 from touching the belt 25. Further, the belt 25 may be disposed at the same height as the sliding surface 6*a*1.

Figure 9:
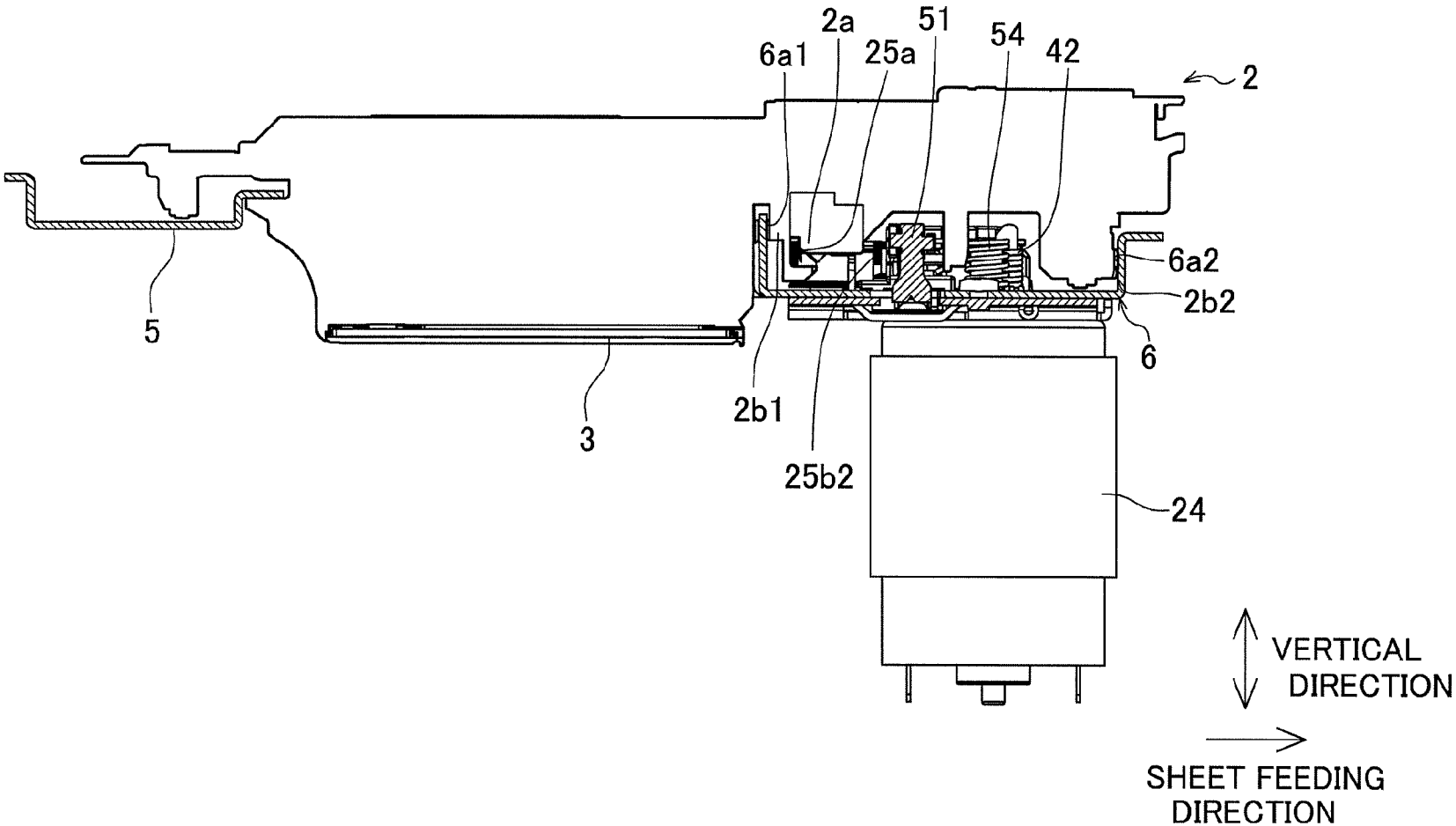
FIG. 9 is a diagram equivalent of FIG. 5, representing modification 3.

The foregoing embodiment described the case where the end portion of the inkjet head 3 on the downstream side of the sheet feeding direction vertically overlaps the sliding surface 6*a*1. However, the present invention is not limited to this. For example, as illustrated in FIG. 9, the inkjet head 3 may have a shorter length in the sheet feeding direction, and the inkjet head 3 as a whole may be disposed upstream of the sliding surface 6*a*1 in the sheet feeding direction. Specifically, the inkjet head 3 is not required to vertically overlap the sliding surface 6*a*1 (modification 3).

The foregoing embodiment described the case where the sliding surface 6*a*1 is the surface on the downstream side of the vertically extending bent portion of the guide rail 6 in the sheet feeding direction at the end portion of the guide rail 6 on the upstream side of the sheet feeding direction. The sliding portion 2*b*1 of the carriage 2 is in contact with the sliding surface 6*a*1 from the downstream side in the sheet feeding direction. However, the present invention is not limited to this. For example, the sliding surface may be the surface on the upstream side of the vertically extending portion of the guide rail 6 in the sheet feeding direction, and the carriage 2 may be provided with a sliding portion which slides on this sliding surface from the upstream side in the sheet feeding direction.

In this case, the carriage 2 does not have the sliding portion between the portion 25*a* of the belt 25 and the sliding surface 6*a*1, and the portion 25*a* of the belt 25 can be disposed even closer to the sliding surface 6*a*1. As a result, the belt grip 2*a* can be brought closer to the center of gravity of the carriage 2.

Figure 10:
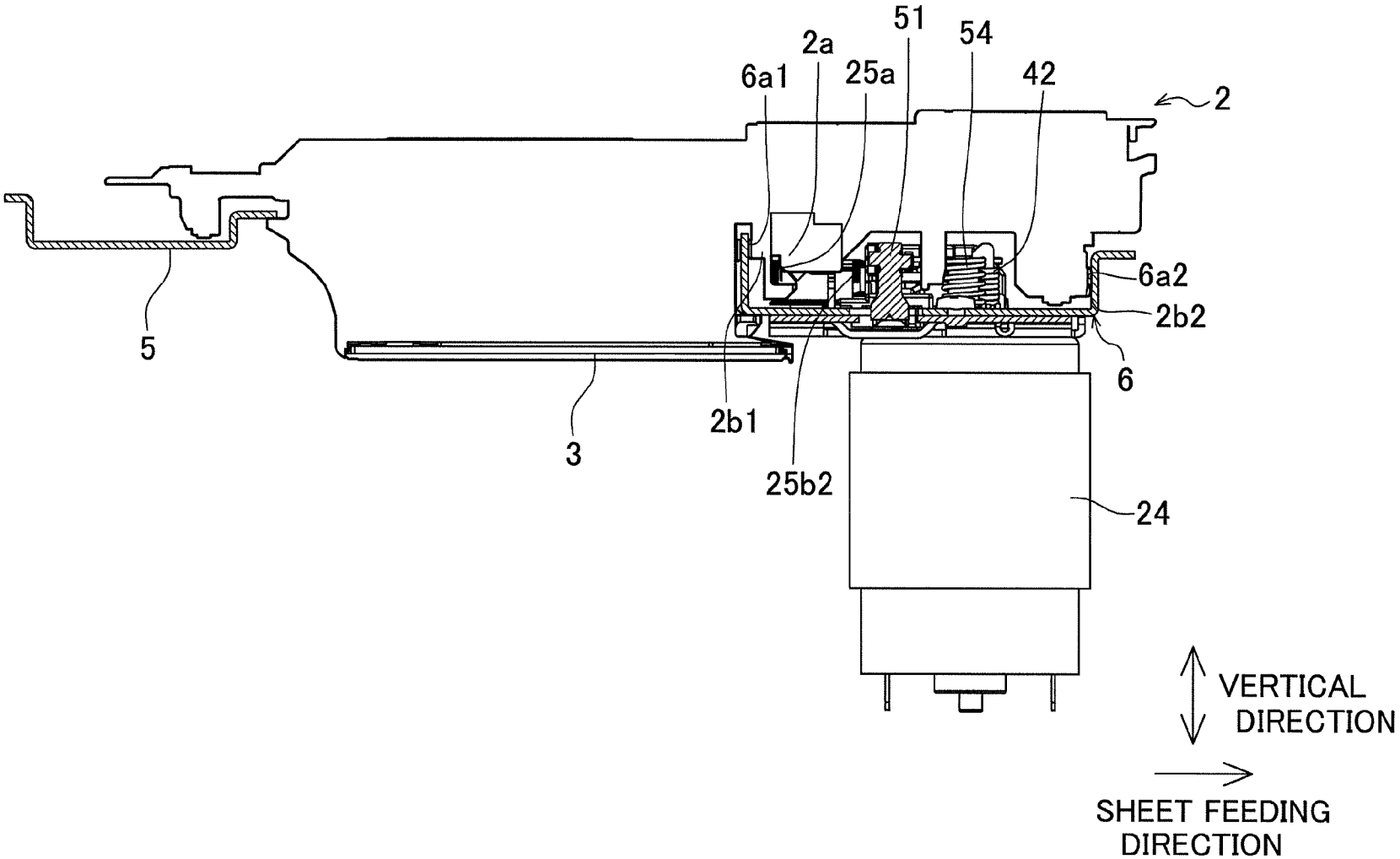
FIG. 10 is a diagram equivalent of FIG. 5, representing modification 4.

The foregoing embodiment described the case where the belt grip 2*a* is disposed downstream of the inkjet head 3 in the sheet feeding direction. However, the present invention is not limited to this. For example, as illustrated in FIG. 10, the inkjet head 3 may have a longer length in the sheet feeding direction, and the belt grip 2*a* and the inkjet head 3 may vertically overlap each other (modification 4). Specifically, the distance between the inkjet head and the belt grip 2*a* in the direction parallel to the sheet feeding direction may be zero, provided that the distance is shorter than the radial difference Rs.

In the foregoing example, the first direction is in parallel with the vertical direction orthogonal to the scanning direction and the sheet feeding direction. However, the present invention is not limited to this.

Figure 11A:
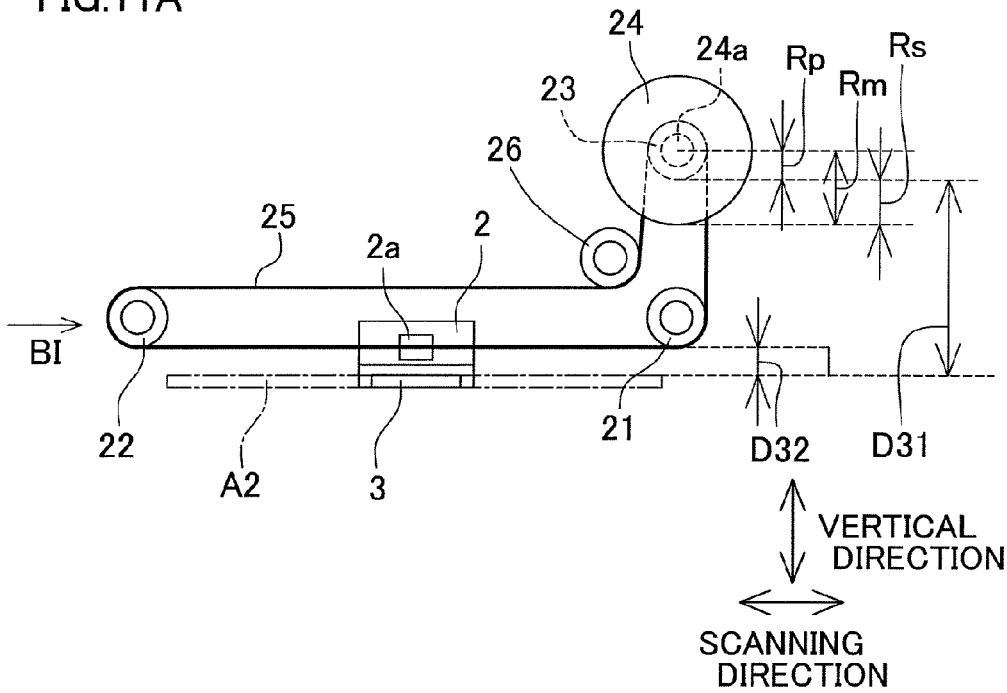
FIG. 11A is a diagram representing the positional relationships between the carriage, the inkjet head, the pulleys, the belt, and the motor of modification 5 as viewed from the downstream side in the sheet feeding direction.
Figure 11B:
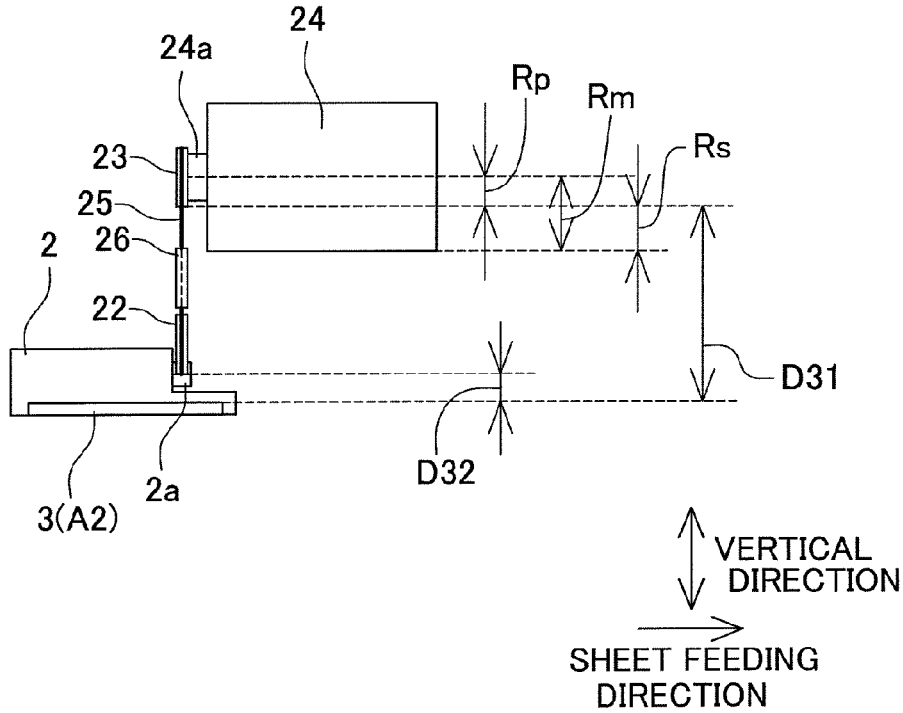
FIG. 11B is a diagram as viewed in the direction of arrow BI in FIG. 11A.

For example, in one modification (modification 5), as illustrated in FIGS. 11A and 11B, the axial directions of the pulleys 21 to 23 and 26, and the axial direction of the shaft 24*a* of the motor 24 are in parallel with the sheet feeding direction. Specifically, the first direction is in parallel with the sheet feeding direction. The pulley 23 is disposed above the pulley 21, separately therefrom. Further, the distance D31 between the pulley 23 and the head passing region A2 of the inkjet head 3 in the vertical direction is greater than the radial difference Rs. The distance D32 between the belt grip 2*a* and the pulley 23 in the vertical direction is smaller than the radial difference Rs. In this case, the vertical direction corresponds to the first direction of the present invention.

Figure 12A:
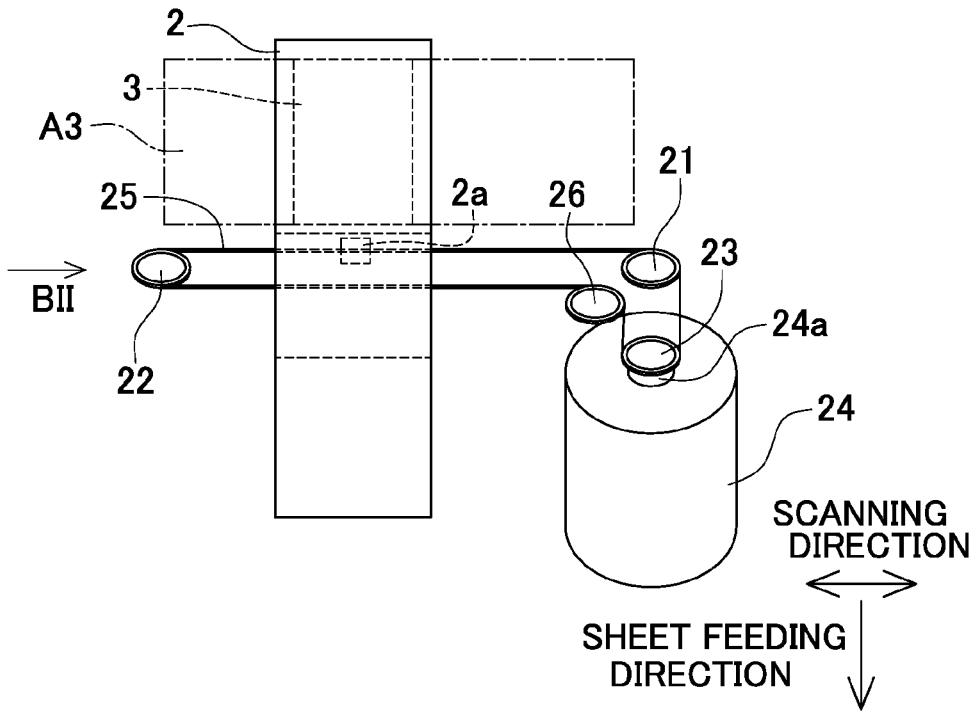
FIG. 12A is a diagram representing the positional relationships between the carriage, the inkjet head, the pulleys, the belt, and the motor of modification 6 as viewed from the direction orthogonal to the scanning direction and the sheet feeding direction.
Figure 12B:
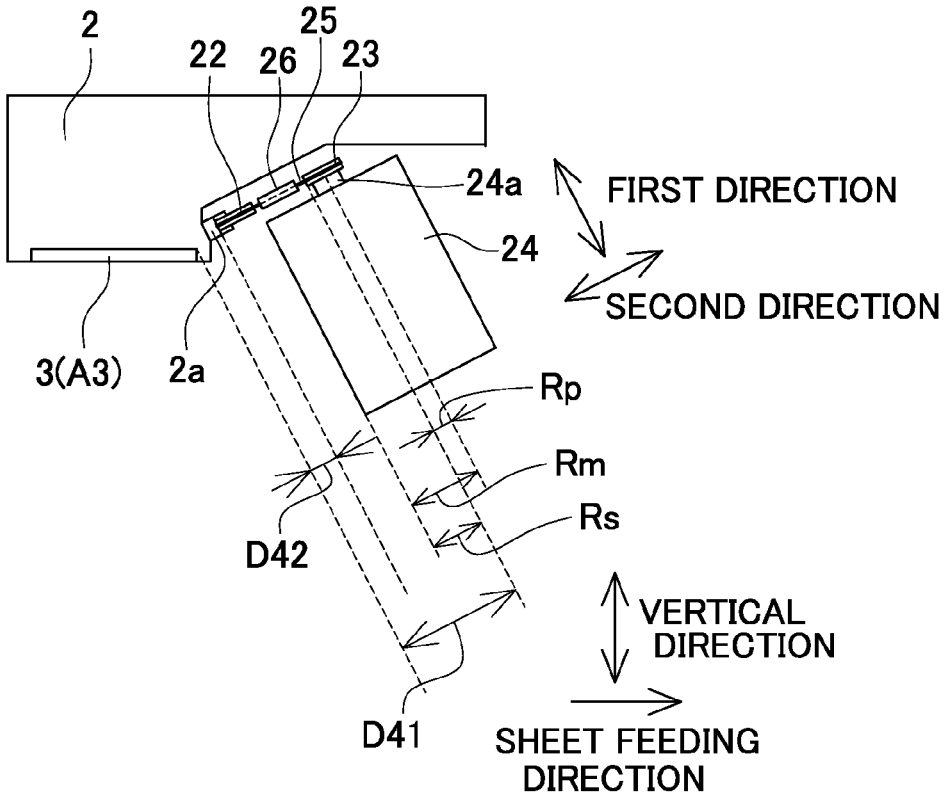
FIG. 12B is a diagram as viewed in the direction of arrow BII in FIG. 12A.

In another modification (modification 6), as illustrated in FIGS. 12A and 12B, the axes of the pulleys 21 to 23 and 26, and the axis of the shaft 24*a* of the motor 24 are tilted with respect to the vertical direction. Specifically, the first direction is tilted with respect to the vertical direction. Accordingly, the axes of the pulleys 21 to 23 and 26, and the axis of the shaft 24*a* of the motor 24 are directed more upstream in the sheet feeding direction toward the upper end. Further, the pulley 23 is separated from the pulley 21 on the opposite side from the inkjet head 3 in the second direction orthogonal to the first direction and the scanning direction. Further, the distance D41 between the pulley 23 and the head passing region A3 of the inkjet head 3 in the second direction is greater than the radial difference Rs. The distance D42 between the belt grip 2*a* and the pulley 23 in the second direction is smaller than the radial difference Rs.

In the printers represented by modifications 5 and 6, the end portion of the motor 24 on the shaft 24*a* side in the first direction overlaps the head passing region A2 and A3 in the second direction. Thus, if the shaft 24*a* of the motor 24 were connected to the pulley 21 or 22, it would not be possible to make the distances D31 and D41 greater than the radial difference Rs and increase the moving range of the carriage 2, and at the same time to make the distances D32 and D42 smaller than the radial difference Rs to bring the belt grip 2*a* closer to the inkjet head 3 in the manner described in the foregoing embodiment.

In modifications 5 and 6, however, the shaft 24*a* of the motor 24 is connected to the pulley 23 different from the pulleys 21 and 22, as in the foregoing embodiment. Thus, the positional relationships between the pulleys 21 and 22 and the pulley 23 can be adjusted according to the radius Rm of the motor 24, and the radius Rp of the pulley 23. In this way, the distances D32 and D42 can be made smaller than the radial difference Rs while making the distances D31 and D41 greater than the radial difference Rs. This makes it possible to bring the belt grip closer to the inkjet head 3 while widening the moving range of the carriage 2.

The present invention has been described through the case of the printer which records an image on record sheet by ejecting ink. However, the present invention is not limited to this example, and is also applicable to liquid ejection apparatuses, other than printers, which eject liquid other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a liquid ejection head configured to eject liquid;

a carriage adapted to hold the liquid ejection head and movable in a predetermined scanning direction;

a first pulley and a second pulley disposed in a housing of the apparatus and separated from each other in the scanning direction, and a first common tangent of the first and second pulleys being in parallel with the scanning direction;

a third pulley disposed in the housing, and a second external common tangent of the first and third pulleys intersecting with the scanning direction;

a motor having a rotatable shaft extended in a first direction and a larger diameter than the third pulley, the shaft being directly connected to the third pulley;

an endless belt wound around the first pulley, the second pulley, and the third pulley as to circumscribe the first pulley, the second pulley, and the third pulley; and a belt connecting portion provided on the carriage and connected to the belt in a portion on the first external common tangent;

the center of gravity of the carriage including the liquid ejection head being positioned as to overlap the liquid ejection head in the first direction, the motor having a portion which overlaps a head passing region, which is a region where the liquid ejection head passes over upon the movement of the carriage, in a second direction orthogonal to the scanning direction and the first direction, the distance between the head passing region and the third pulley in the second direction being greater than a radial difference obtained as the length of the radius of the motor minus the radius of the third pulley, and the belt connecting portion being disposed between the liquid ejection head and the third pulley in the second direction, and the distance between the head passing region and the belt connecting portion in the second direction being smaller than the radial difference.

2. The liquid ejection apparatus according to claim 1, wherein the third pulley is positioned within the both ends of the maximum travel range of the carriage in the scanning direction, and wherein the distance between the third pulley and the either end of the maximum travel range in the scanning direction is equal to or greater than the radial difference.

3. The liquid ejection apparatus according to claim 1, further comprising a sliding surface provided in contact with the carriage from the second direction and extending in the scanning direction, wherein the carriage slides on the sliding surface in the scanning direction to be movable in the scanning direction while being restricted from rotating in directions about the axis of the shaft.

4. The liquid ejection apparatus according to claim 3, wherein the belt connecting portion is away from the center of gravity of the carriage in the second direction than the sliding surface, and wherein the sliding surface is disposed where overlaps the liquid ejection head in the first direction.

5. The liquid ejection apparatus according to claim 3, wherein grease is applied to the sliding surface for smooth sliding with the carriage, and wherein the belt is disposed offset from the sliding surface in the first direction.

6. The liquid ejection apparatus according to claim 1, further comprising a fourth pulley contacting an outer surface of the belt and bending the belt in a portion between the second pulley and the third pulley, and an internal common tangent of the second and fourth pulleys being substantially in parallel with the scanning direction.

7. The liquid ejection apparatus according to claim 6, further comprising an encoder which includes:

an encoder film extending in the scanning direction and disposed in a space between the belt in a portion from the second pulley to the fourth pulley and a plane which passes through the axis of the third pulley, and is in parallel with the scanning direction; and a position detecting element which detects a position of the carriage with the encoder film.

8. The liquid ejection apparatus according to claim 1, wherein the axial positions of all pulleys which are contact with the belt are fixed.

* * * * *